US009266344B2

(12) United States Patent
Moens

(10) Patent No.: US 9,266,344 B2
(45) Date of Patent: Feb. 23, 2016

(54) PRINT HEAD WITH INK HANDLING UNIT

(71) Applicant: OCÉ-TECHNOLOGIES B.V., Venlo (NL)

(72) Inventor: Marco T. R. Moens, Venlo (NL)

(73) Assignee: OCÉ-TECHNOLOGIES B.V., Venlo (NL)

( * ) Notice: Subject to any disclaimer, the term of this patent is extended or adjusted under 35 U.S.C. 154(b) by 0 days.

(21) Appl. No.: 14/713,069

(22) Filed: May 15, 2015

(65) Prior Publication Data

US 2015/0336392 A1 Nov. 26, 2015

(30) Foreign Application Priority Data

May 21, 2014 (EP) ..... 14169331

(51) Int. Cl.

| | |
|---|---|
| ***B41J 2/175*** | (2006.01) |
| ***B41J 2/18*** | (2006.01) |
| *B41J 2/14* | (2006.01) |

(52) U.S. Cl.

CPC ..... *B41J 2/17563* (2013.01); *B41J 2/175* (2013.01); *B41J 2/17513* (2013.01); *B41J 2/17566* (2013.01); *B41J 2/17593* (2013.01); *B41J 2002/14403* (2013.01)

(58) Field of Classification Search

CPC ..... B41J 2/175; B41J 2/18; B41J 2/17563; B41J 2202/12; B41J 2/17566; B41J 2/17523

USPC ..... 347/7, 55, 85, 89, 93

See application file for complete search history.

(56) References Cited

U.S. PATENT DOCUMENTS

| | | | | |
|---|---|---|---|---|
| 6,485,127 | B2 * | 11/2002 | Ohsawa et al. | 347/55 |
| 7,300,143 | B2 * | 11/2007 | Slotto et al. | 347/86 |
| 2001/0050017 | A1 | 12/2001 | Ohsawa et al. | |
| 2001/0050695 | A1 | 12/2001 | Moriyama et al. | |
| 2001/0050702 | A1 | 12/2001 | Ohsawa et al. | |
| 2006/0221146 | A1 | 10/2006 | Slotto et al. | |

FOREIGN PATENT DOCUMENTS

| | | | |
|---|---|---|---|
| EP | 1 760 124 | A1 | 3/2007 |
| EP | 2 216 177 | A1 | 8/2010 |
| JP | S63-260447 | A | 10/1988 |
| JP | H10-109430 | A | 4/1998 |
| JP | 2006-289977 | A | 10/2006 |
| JP | 2013-220625 | A | 10/2013 |
| WO | WO 2007/025893 | A1 | 3/2007 |

* cited by examiner

*Primary Examiner* — An Do

(74) *Attorney, Agent, or Firm* — Birch, Stewart, Kolasch & Birch, LLP

(57) ABSTRACT

An ink jet print head with an integrated ink handling unit includes a heater and a filter for the ink. The ink handling unit has an inlet port for liquid ink and a circulation system connected to the inlet port and adapted to pass the liquid ink through the heater and to the filter. The circulation system includes a single, non-branched duct that passes continuously from the inlet port to the filter, and the duct of the circulation system passes in meander fashion through a heated block of the heater.

11 Claims, 1 Drawing Sheet

PRINT HEAD WITH INK HANDLING UNIT

CROSS-REFERENCE TO RELATED APPLICATIONS

This application claims priority under 35 U.S.C. §119(a) to Application No. 14169331.7, filed in Europe on May 21, 2014, the entire contents of which is hereby incorporated by reference into the present application.

BACKGROUND OF THE INVENTION

1. Field of the Invention

The present invention relates to an ink jet print head with an integrated ink handling unit that comprises a heater and a filter for the ink. The present invention further relates to an ink jet printing method using such a print head.

2. Description of Background Art

Print heads with such an integrated ink handling unit have heretofore been known only for hot-melt printers, which use an ink that is solid at room temperature and needs to be heated in order to be liquefied and capable of being processed in a drop forming unit of the print head. The hot melt ink is supplied, for example, in the form of pills that are melted in the heater of the ink handling unit.

EP 1 760 124 A1 and WO 2007/025893 A1 disclose inks that can take the form of a gel at ambient temperature. In order to supply this ink to the print head and to jet it out, the ink must be de-gelled, e.g. by heating the entire printer or at least the entire ink handling system.

SUMMARY OF THE INVENTION

It is an object of the present invention to provide a print head that is capable of working with a new type of ink, in particular a UV gelling ink.

In the print head according to the present invention, the ink handling unit has an inlet port for liquid ink and a circulation system connected to the inlet port and adapted to pass the liquid ink through the heater and to the filter.

This ink handling unit permits, for example, to process a UV-curable thermo-reversible gelling ink, e.g. an ink that contains a gelling agent, e.g. a wax suspended in a liquid acrylic substance.

Although the ink is liquid, it cannot be filtered as it is, because the wax would be filtered out. With the print head according to the present invention, the liquid ink can be heated to a temperature at which the gelling agent can pass through the filter, so that the consistency of the ink is preserved in the filtering process. Since the ink can be filtered as late as immediately before use, the ink can be prevented from cooling and gelling after filtering, and any re-contamination of the filtered ink can be avoided reliably. Since the heater is also integrated in the print head, heat losses and costs for thermal isolation or heating of the ink supply system are minimized. Moreover, the ink supply system including the ink handling unit can have a design, which minimizes the risk that air bubbles that would be harmful to the drop forming process are introduced into the ink.

More specific optional features of the present invention are indicated in the dependent claims.

In a preferred embodiment, the ink handling unit further includes an integrated ink reservoir for the filtered ink. This reservoir serves as a buffer and permits to respond to a varying demand of the drop forming system for ink. Since the ink reservoir is disposed close to the heater, the ink in the reservoir may also be kept at an elevated temperature. This is particularly useful for an ink that tends to start gelling when it has once been heated and is then cooled down again.

In order to prevent the introduction of air bubbles into the ink, the circulation system is preferably formed by a single, relatively long and meandering duct that leads continuously from the inlet port to the filter. This assures that any air bubbles contained in the ink will be driven through the duct by the flow of ink without being trapped at any discontinuities of the ink duct.

The filter preferably comprises an inlet chamber and an outlet chamber that are separated by a vertically extending wall-like filter element, so that any air bubbles contained in the ink may rise in both the inlet chamber and the outlet chamber and may thereby be separated from the ink. In this way, a self-priming ink supply system can be obtained. Preferably, the ink is supplied to the filter at the bottom end of the inlet chamber and withdrawn from the filter at the top end of the outlet chamber.

The ink reservoir preferably contains a capacitive level sensor for measuring the level of ink in the reservoir. Since the capacitance of the sensor is influenced by the electric permittivity of the ink, the capacitor electrodes of the sensor need not be in direct contact with the ink, so that any detrimental physical or chemical interactions of the ink with the sensor can be avoided. Moreover, the ink reservoir can be kept at a controlled pressure by controlling the pressure of an air cushion above the ink level.

In another aspect, the present invention relates to an ink jet printing method comprising the steps of providing a thermo-reversible gelling ink in a de-gelled state; heating the ink and filtering the heated ink in an integrated ink handling unit of a print head; and supplying the filtered ink at an elevated temperature to a drop forming unit of the print head.

In an embodiment, the ink used in the method is a UV-curable and/or UV-gelling ink.

In an embodiment, the de-gelled ink is provided by mechanically stirring the ink at ambient temperature.

Further scope of applicability of the present invention will become apparent from the detailed description given hereinafter. However, it should be understood that the detailed description and specific examples, while indicating preferred embodiments of the invention, are given by way of illustration only, since various changes and modifications within the scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE PREFERRED EMBODIMENTS

Figure 1:
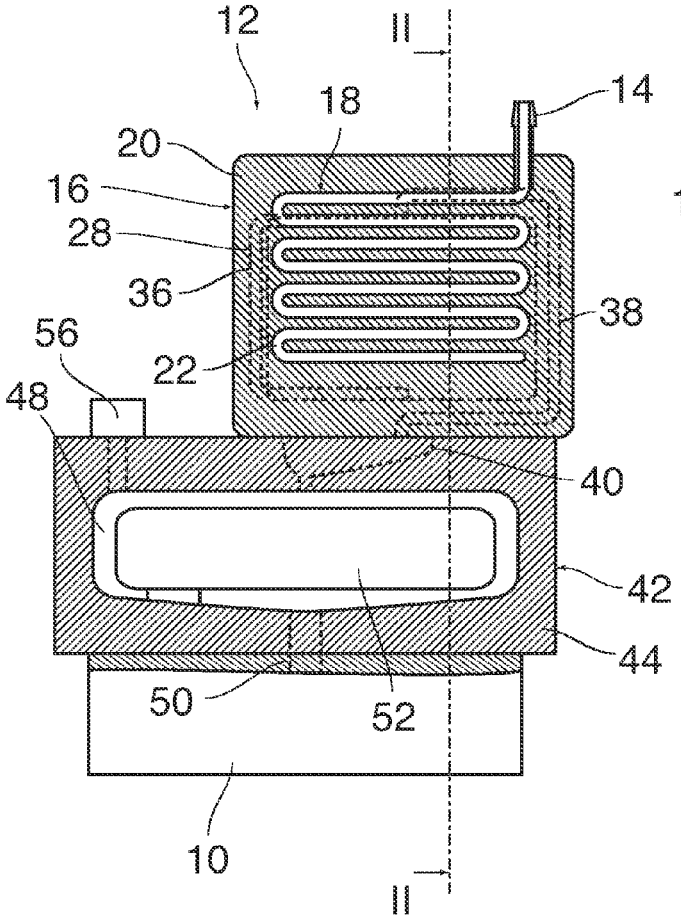
FIG. 1 is a schematic sectional view of an ink jet print head according to the present invention.

The present invention will now be described with reference to the accompanying drawings, wherein the same reference numerals have been used to identify the same or similar elements throughout the views.

The print head shown in FIG. 1 comprises a drop forming unit 10 integrated with an ink handling unit 12.

The drop forming unit 10 comprises nozzles and actuators, e.g. piezoelectric actuators for ejecting ink droplets onto a recording medium, as is well known in the art. The drop forming unit has therefore not been illustrated in detail.

The ink handling unit 12 is adapted to handle an ink that is liquid at room temperature and can be caused to gel after it has been deposited on the recording medium. Gelling may be induced, for example, by irradiating the printed image with UV radiation and/or by suitable thermal treatment.

The ink handling unit 12 is mounted on the drop forming unit 10, and both units together may, for example, form a carriage that moves across a feed path for the printing medium. Liquid ink may be supplied to the ink handling unit via a flexible tube that is connected to an inlet port 14 provided on a top side of a heater 16 that forms an essential part of the ink handling unit.

From the supply port 14, the liquid ink will enter into a circulation system 18 in the form of a single (non-branched) continuous duct that is formed in a block 20 of the heater. The block 20 is made of a material with a high thermal conductivity, e.g. of aluminium. The duct of the circulation system 18 has a relatively small and constant diameter but a relative large length, in the order of magnitude of, e.g. 500 mm and passes in meander fashion in several layers of serpentines through the block 20. In FIG. 1, the cross-sectional plane passes through one serpentine layer 22 of the circulation system. At the bottom end of the serpentine, the duct turns into the direction normal to the plane of the drawing in FIG. 1 and enters into a second serpentine layer 24, as has been shown in FIG. 2.

The block 20 contains electric heating elements 26 that are electrically isolated from the block 20 by ceramic material and are disposed such that a good heat transfer onto the serpentine layers 22, 24 of the circulation system 18 is achieved.

Figure 2:
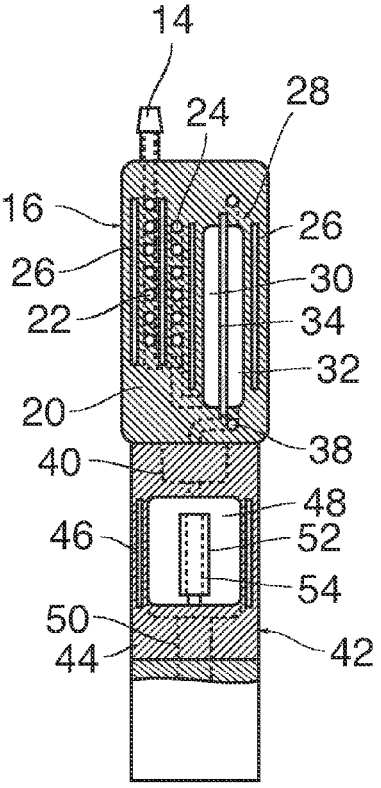
FIG. 2 is a sectional view taken along the line II-II in FIG. 1.

As is further shown in FIG. 2, the block 20 further contains a filter 28 with an inlet chamber 30 and an outlet chamber 32 that are separated by a wall-like vertically extending filter membrane 34.

The circulation system has a descending portion 36 (FIG. 1) that connects the downstream (upper) end of the serpentine layer 24 of the heater 16 to the bottom of the inlet chamber 30. While the ink passes through the filter membrane 34 into the outlet chamber 32, any air bubbles that may possibly be entrained in the flow of ink can rise upwardly in the inlet chamber 30, and the accumulated air may be vented at the top end of the this chamber.

An ink duct 38 connects the top end of the outlet chamber 32 of the filter to an inlet port 40 of an ink reservoir 42. The ink reservoir 42 is formed in another block 44 of aluminium which may optionally include further heating elements 46 and forms a reservoir chamber 48 where the filtered ink is buffered and kept at a suitable temperature for preventing gelling. In this example, the block 44 engages the bottom wall of the block 20 and is therefore in thermal contact with the heater. An outlet port 50 connects the reservoir chamber 48 to the drop forming unit 10.

The reservoir chamber 48 contains a capacitive level sensor 52 for detecting the level of ink in the reservoir chamber 48. The level sensor 52 includes capacitor electrodes 54 (FIG. 2), which are accommodated in a housing of the sensor so as to prevent direct contact of the electrodes with the liquid in the reservoir chamber 48. The capacitor electrodes 54 detect the capacitance of capacitors formed by these electrodes and the electrically conductive walls of the block 44, with the liquid ink serving as a dielectric where the sensor 52 is immersed in the ink. The level sensor 52 may be used for feedback controlling a pump in a supply system with which ink is supplied to the inlet port 14 of the ink handling unit 12.

As is further shown in FIG. 1, a pressure control system 56 is provided for controlling the pressure of the air above the level of the ink in the reservoir chamber 48, thereby controlling the pressure of the ink that is supplied to the drop forming unit 10.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. An ink jet print head, comprising:

an integrated ink handling unit comprising:

an inlet port for liquid ink;

a heater;

a filter for the ink; and a circulation system connected to the inlet port and adapted to pass the liquid ink through the heater and to the filter, wherein the circulation system comprises a single, non-branched duct that passes continuously from the inlet port to the filter, and the duct of the circulation system passes in meander fashion through a heated block of the heater.

2. The print head according to claim 1, wherein the filter is embedded in the heated block of the heater.

3. The print head according to claim 1, wherein the filter has an inlet chamber and an outlet chamber separated by a vertically extending filter membrane.

4. The print head according to claim 3, wherein the circulation system is connected to a bottom end of the inlet chamber.

5. The print head according to claim 1, further comprising an ink reservoir connected to an outlet side of the filter and disposed to be in thermal contact with the heater.

6. The print head according to claim 5, wherein the filter has an inlet chamber and an outlet chamber separated by a vertically extending filter membrane, and wherein the ink reservoir is connected to a top end of the outlet chamber of the filter.

7. The print head according to claim 5, wherein the ink reservoir comprises a capacitive level sensor for detecting the level of ink in the ink reservoir.

8. The print head according to claim 5, further comprising a pressure control system for controlling the pressure of air above the level of ink in a closed reservoir chamber of the ink reservoir.

9. An ink jet printing method comprising the steps of:

providing a thermo-reversible gelling ink in a de-gelled state, the ink containing a gelling agent;

heating the ink and filtering the heated ink in an integrated ink handling unit of a print head, wherein the ink is heated to a temperature at which the gelling agent can pass through the filter; and supplying the filtered ink at an elevated temperature to a drop forming unit of the print head.

10. The method according to claim 9, wherein the ink is a UV-curable and/or UV-gelling ink.

11. The method according to claim 9, wherein the de-gelled ink is provided by mechanically stirring the ink at ambient temperature.

* * * * *